US006320346B1

(12) United States Patent
Graf

(10) Patent No.: US 6,320,346 B1
(45) Date of Patent: Nov. 20, 2001

(54) DCC DECODER FOR MODEL RAILROAD

(75) Inventor: Paul Graf, Middlesex, NJ (US)

(73) Assignee: Atlas Model Railroad Company, Incorporated, Hillside, NJ (US)

( * ) Notice: Subject to any disclaimer, the term of this patent is extended or adjusted under 35 U.S.C. 154(b) by 0 days.

(21) Appl. No.: 09/637,852

(22) Filed: Aug. 11, 2000

(51) Int. Cl.[7] ..... G05D 1/00

(52) U.S. Cl. ..... 318/580; 318/587; 318/39; 104/301; 246/167; 246/187

(58) Field of Search ..... 318/39, 587, 588, 318/589, 590, 34; 104/301; 246/187, 167

(56) References Cited

U.S. PATENT DOCUMENTS 3,666,217 * 5/1972 Sibley ..... 246/34
3,994,237 * 11/1976 Thomsen ..... 104/149
4,024,502 * 5/1977 Eberwein et al. ..... 340/147 R
4,108,269 * 8/1978 Nakao ..... 180/98
4,335,381 * 6/1982 Palmer ..... 340/825.21
4,388,573 * 6/1983 Horiuchi et al. ..... 318/376
4,572,996 * 2/1986 Hanschke et al. ..... 318/341
4,734,861 * 3/1988 Bertolasi et al. ..... 364/424.1
4,791,570 * 12/1988 Sherman et al. ..... 364/436
4,902,948 * 2/1990 Sherman et al. ..... 318/580
4,912,471 * 3/1990 Tyburski et al. ..... 342/42
5,004,962 * 4/1991 Fonss et al. ..... 318/85
5,073,750 * 12/1991 Coron ..... 318/587
5,441,223 * 8/1995 Young et al. ..... 246/6
5,493,642 * 2/1996 Dunsmuir et al. ..... 395/161
5,638,522 * 6/1997 Dunsmuir et al. ..... 395/326
5,711,497 * 1/1998 Andrianos et al. ..... 246/34 B
5,749,547 * 5/1998 Young et al. ..... 246/4
5,773,939 * 6/1998 Severson et al. ..... 318/51
5,775,524 * 7/1998 Dunham ..... 213/75
5,952,797 * 9/1999 Rossler ..... 319/39
6,065,406 * 5/2000 Katzer ..... 105/1.5
6,095,351 * 8/2000 Rossler ..... 213/75
6,250,987 * 6/2001 Choi ..... 446/436

* cited by examiner

*Primary Examiner*—Robert E. Nappi
*Assistant Examiner*—Tyrone Smith
(74) *Attorney, Agent, or Firm*—Leonard Bloom

(57) ABSTRACT

An apparatus for controlling a model railroad locomotive includes a Digital Command Control (DCC) decoder and a power switch. The power switch selectively connects the railroad locomotive's motor to either the decoder or directly to an energy source, such as the tracks, but not both the decoder and the energy source simultaneously. When the motor is connected directly to the energy source, rather than through the decoder, the model railroad locomotive speed and direction is determined by the magnitude and polarity of the voltage applied. The motor may alternatively be powered through the decoder by actuating the power switch. The decoder receives electrical energy as an input, and converts the energy to deliver as an output a variable electric motor drive power source. In addition to receiving energy as an input, the decoder also receives electrical signals representative of an operator's control instructions. These control signals are used by the decoder to effect both speed and direction control of the locomotive relatively independently of the magnitude and polarity of the decoder electrical energy input. A plurality of DCC locomotives may each be individually controlled independently of the others upon a common track, or the power switches of each locomotive may be actuated to enable simultaneous analog control of a plurality of the locomotives by a single controller.

20 Claims, 3 Drawing Sheets

DCC DECODER FOR MODEL RAILROAD

BACKGROUND OF THE INVENTION

1. Field of the Invention

This invention pertains generally to model railroad locomotives. More specifically, the present invention incorporates a switch in a model railroad locomotive for selectively powering an electric motor within the locomotive using either Digital Command Control (DCC) or analog control.

2. Description of the Related Art

Model railroads have existed for many years, and have delighted many generations of people. These model railroads can be very simple, consisting of a small loop of track, a locomotive and an analog controller such as a transformer and rheostat or a variable transformer. Power is transmitted through the track from the analog controller to the locomotive. In FIG. 1, the electrical portion of a simple analog locomotive is illustrated, having power pickup through each of two rails. The power is provided directly to an electrical motor M1 and, in a slightly fancier locomotive, also to one or more lights L1. As the voltage differential between the left and right rails increases, motor M1 will be induced to rotate faster, and light L1 will burn brighter.

While this simple model railroad is adequate for some operators, a model railroad can also desirably be quite intricate and detailed, including thousands of feet of track, many locomotives, cars and cabooses, and even lights and whistles. As the model railroad gets more elaborate, it is quite common to have multiple engines operating upon the same track. Unfortunately, using the simple early controllers, it was not possible to independently control each of the engines. Instead, the track was controlled by the controller, and every engine upon the track would be operated using the same control, and would consequently operate at approximately the same speed and travel in the same direction. Whistles would sound in unison and lights illuminate in unison. Therefore, rather than controlling the trains the way a real train engineer would, a model railroad operator would instead be forced to control the track.

Further difficulties were encountered when the rheostat and power supply were not sufficiently robust to support the number of engines being operated upon the track. Prior to the implementation of electronically controlled model railroad engines, several techniques were used to provide more flexibility to the track operator. One option was to run parallel tracks, allowing several trains to run over nearly the same path, while still being separately controlled. Undesirably, this technique also required multiples of track, thereby increasing the cost in proportion to the number of independent tracks. To add a second track will, of course, double the amount of track and also double the amount of time needed to assemble the track. Furthermore, depending upon the desired track layout, there might not always be sufficient space for multiple tracks laid side by side. Finally, the aesthetic appearance of these multiple parallel tracks was in many cases unsatisfactory.

As an alternative, various sections of the track could be electrically blocked or isolated from other sections, and powered separately. Then, rather than having an entire track operating at a single speed and direction, it is possible to vary the speed of an engine from one section of track to another. Additionally, lights and whistles may be controlled independently upon these different sections of track.

Unfortunately, while the track operator has greater flexibility with this blocking technique or with multiple tracks, the operator is still controlling the track and not the train. Furthermore, the behavior of these analog controllers does not fully reflect the behavior of an actual train. Model trains using electric motors tend to come up to speed quite rapidly, and will tend to lurch when the applied power varies suddenly. In contrast, a real train has unique motion or acceleration characteristics that describe how fast it speeds up and slows down. The acceleration characteristics of a real train are determined by the weight of the train, the available torque within the locomotive, the terrain being traveled, and whether the locomotive is operating individually or as part of a multiple unit lash-up.

More recently, with the advent of more capable and complex electronic circuitry, electronic motor controllers have been developed that allow track operators to become model railroad engineers, controlling the speed and direction of each train independently of other trains upon a track, rather than controlling the track. These newer electronic control systems are commonly referred to as Digital Command Control (DCC), where a digital control signal is passed to a decoder. For the purposes of this disclosure, a decoder will be defined herein to be an electronic circuit which, when installed in a locomotive or similar machine, receives digital packets of information from a command station and either supplies power to the locomotive motor or controls features on the locomotive such as lights, sound or other auxiliary devices. These control signals may be used by the decoder to effect both speed and direction control of the engine relatively independently of the magnitude and polarity of the decoder electrical energy input. When the motor is powered through the decoder, digital code words are used to uniquely identify each train upon a track. The unique code word is sent out together with control instructions, and only the unique decoder addressed by the code word will process those particular control instructions. In this way, multiple trains may each be controlled independently on a single track. A block diagram of a DCC type decoder is illustrated in FIG. 2. Power is provided from left and right rail pickups, and passes through a decoder for regulation and delivery to motor M1 and one or more lights or whistles L1.

Several patents are exemplary of the use of a DCC, including Hanschke et al in U.S. Pat. No. 4,572,996 and Rossler in U.S. Pat. No. 2,571,723, each which are incorporated herein by reference for their teachings of DCC systems. In Hanschke et al, an electronic circuit monitors the voltage across a track for pulses. When pulses are detected, the digital code present within the pulses is analyzed for instructions regarding speed. When pulses are not detected, and after passing through a bridge rectifier and Darlington transistor, the track power is applied to the motor. However, until a track voltage great enough to energize the electronic circuit is reached, the Darlington transistors will not be energized, and the train will not operate. Furthermore, even when operational, there will still be an equivalent of approximately four diode voltage drops, two across the bridge rectifier and an equivalent of two more through a Darlington transistor. This voltage drop will amount to approximately three volts, which is a substantial voltage differential between the Hanschke et al vehicle and an analog train. Consequently, the Hanschke et al patent operates as illustrated in prior art FIG. 2 illustrated herein, which requires power from the rails to pass through a decoder before being provided to motor M1. In Rossler, a plurality of motors are provided which may be separately controlled through the decoder, to effect movement of the locomotive. The concept of uniquely addressing different locomotives is also discussed, as are a number of other DCC concepts. Nevertheless, like Hanschke et al, the decoder of Rossler intervenes between power at the rails and the motor.

Unfortunately then, prior art DCC decoders require sufficient voltage to operate the electronic circuitry before the motor will be powered, just as illustrated in the Hanschke et al and Rossler patents. The motor must be powered before the engine can begin to move the train, and the voltage required to operate electronic circuitry is greater than that normally required to start an analog engine. Unfortunately, this also means that an analog engine will attempt to drive the train prior to the DCC engine being powered. The resultant mechanical load on the analog train motor may be too great, particularly with a relatively low starting voltage and the resultant low starting torque. Should the load be too great, the motor may draw too much current and overheat or otherwise be damaged, or potentially cause damage to other parts of the system. Consequently, it has not been possible in the prior art to lash together analog trains taking power directly from the track with trains that first condition the power through a decoder. Where an analog track is used to power separate analog and DCC locomotives, and where the voltage applied is relatively low, there will also be an undesirable and significant speed difference between the analog and DCC locomotives.

Efforts have been made in the prior art to condition a digital signal to allow it to power analog trains as well as DCC trains. This may be accomplished by forming a control signal which will activate a DCC train, and which will also provide an RMS voltage appropriate for an intended analog drive. A patent exemplary of this technique is U.S. Pat. No. 5,749,547 to Young et al, the contents of which is also incorporated herein by reference. In Young et al, a digital signal may be provided through various techniques, including DC offsets superimposed onto an AC signal, or through various transmission techniques including RF transmission and frequency shift keying (FSK). Nevertheless, this technique disclosed by Young et al still requires voltages high enough to enable the electronic circuit before energizing the motor, and further requires relatively complex and expensive hardware and software to implement. As might be appreciated, this method requires complex circuitry to generate the DCC signals, and only applies to tracks that include this type of controller. Furthermore, the variations amongst electrical motors are great enough that not all analog locomotives can be powered this way without damage. What is desired then is a way to selectively control a model railroad locomotive with either DCC or analog control, thereby allowing an analog train locomotive and a train locomotive controlled by the present invention to be ganged together into a single train on the track, without risking damage to either locomotive.

SUMMARY OF THE INVENTION

In a first manifestation, the invention is an electrically powered dual control locomotive. The inventive locomotive offers compatibility with both digital and analog model railroad control systems, and may therefore be operated under either analog or DCC control. The dual control locomotive may further be directly connected to an analog locomotive for operation in tandem upon an analog track without damaging either the analog locomotive or the dual control locomotive. The dual control locomotive includes a coupler which receives electrical power and control signals from a power and control source. A decoder receives the control signals and electrical power from the coupler and converts electrical power, responsive to control signals, into a variable electric motor drive source. An electric motor is capable of converting either of the electrical power or the variable electric motor drive source into mechanical energy. A switch selectively electrically connects the electric motor to electrical power from the coupler in a first configuration and selectively connects the electric motor to the variable electric motor drive source in a second configuration.

In a second manifestation, the invention is, in combination, a Digital Command Control (DCC) decoder, an electric motor, and a power switch. The decoder has electronic circuitry for receiving and evaluating various digital commands and responsive thereto modifies an input power source to produce a modified power source. The electric motor converts a motor electrical input supply into mechanical energy. The power switch selectively couples either the decoder or the input power source through an electrical contactor to the motor electrical input supply, the electrical contactor having fixed electrical resistance and a voltage drop therethrough which is linearly related to current passing therethrough.

In a third manifestation, the invention is an electric model railroad having an electrically energized track and an analog locomotive which traverses the track and receives electrical power therefrom. The track power effects both speed and direction control of the analog locomotive. The improvement comprises a dual-powered locomotive physically attached to the analog locomotive. The dual-powered locomotive has an analog power input from the track, a decoder for receiving and converting digital command control signals into a variable motor drive signal, a motor for driving the locomotive, and a switch selectively applying analog power input in a first switching state to the motor and selectively applying the variable motor drive signal to the motor in a second state.

OBJECTS OF THE INVENTION

A first object of the invention is to enable a DCC locomotive to selectively operate under analog control. A second object of the invention is to provide a locomotive which is fully backward compatible with early model trains, and which also offers the benefits of modern electronic control. A third object of the invention is to incorporate modern features enabled by electronic control, including simplified track wiring, control of multiple auxiliary functions, and ready future expansion of capabilities and auxiliary functions. Another object of the invention is to provide an electronic circuit with minimal parts count, which results in a low manufactured cost, higher production yield, and other associated benefits. Yet another object of the invention is to implement the circuitry in a way which offers manufacturing flexibility without necessitating changes in hard tooling. An additional object of the invention is to more closely emulate actual train operation through motor control, to simulate loaded acceleration and deceleration. These and other objects are achieved in the present invention, which may be best understood by the following detailed description and drawing of the preferred embodiment.

DESCRIPTION OF THE PREFERRED EMBODIMENT

Figure 1:
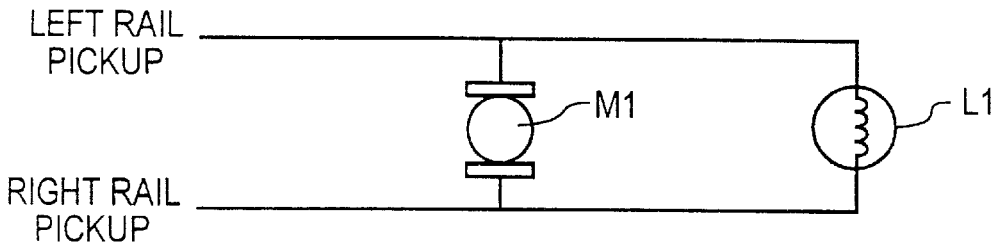
FIG. 1 (PRIOR ART)
FIG. 1 illustrates by block diagram a prior art analog locomotive motor and lights, discussed herein above.
Figure 2:
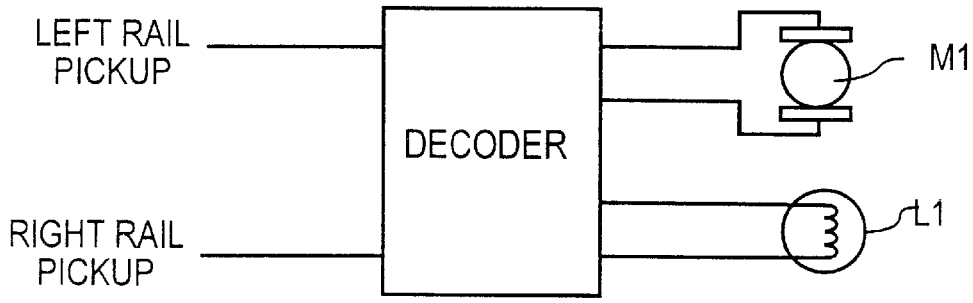
FIG. 2 (PRIOR ART)
FIG. 2 illustrates by block diagram a prior art DCC locomotive decoder, motor and lights, discussed herein above.
Figure 3:
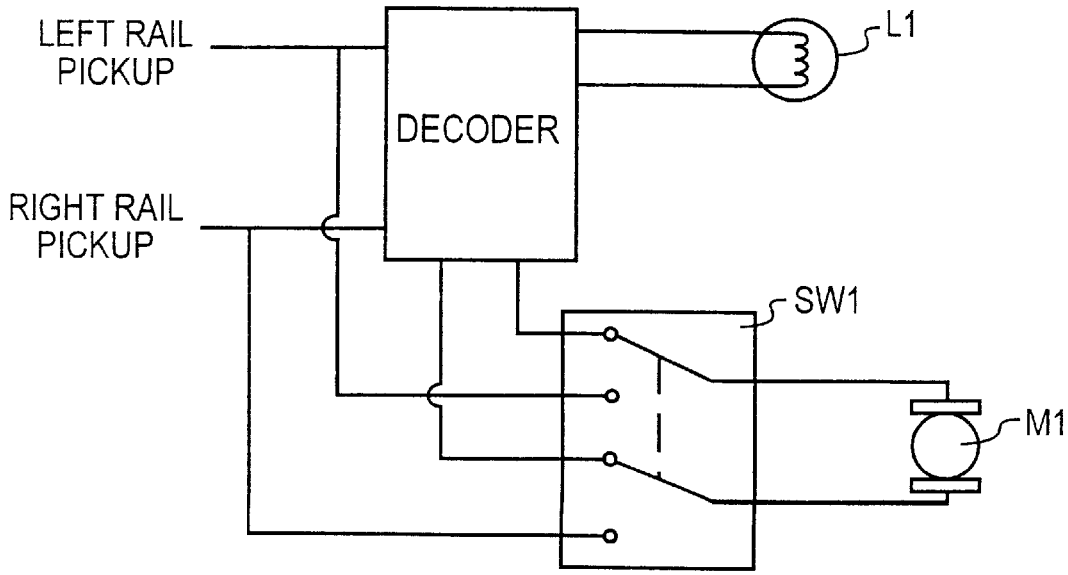
FIG. 3 illustrates by block diagram a preferred embodiment switchable DCC and analog locomotive designed in accordance with the teachings of the present invention, including a decoder, lights, motor and switch.

A preferred embodiment dual control locomotive is illustrated in FIG. 3 by simplified block diagram. As illustrated therein, power for the locomotive is derived most preferably from a source differentially applied between the two rails of a track. The power transmitted through the track is controlled by switch SW1 to pass either directly to motor M1, in the analog mode, or alternatively through the decoder, in the DCC mode. While light L1 is shown in FIG. 3 as being powered solely through the decoder, an alternative embodiment dual control locomotive could be provided with a second switch identical to switch SW1 for controlling power flow into lights L1, or switch SW1 might simply be expanded to accommodate lights L1. Switch SW1 is most preferably a low-loss type switch, though it may be mechanical, electrical or electro-mechanical in nature. More specifically, switch SW1 will desirably not drop any more voltage or power than would be represented by variations in operation from train to train. By limiting the voltage and power drop this way, the presence of switch SW1 within the circuit will only negligibly, at most, degrade the direct connection between the track and motor M1 when switch SW1 otherwise directly connects these together. Most preferably, switch SW1 will offer only intrinsic resistance, and not otherwise drop any voltage. Metallic electrical connectors and switch contactors each present only contact and bulk resistance, and the voltage drop across a metallic connector or a switch contactor is linearly related to the current through the device, in accord with Ohm's law. On the contrary, an electronic device such as a diode or transistor has a voltage drop across the semi-conductor junction which is not Ohmic in nature, and which is not linear with respect to current through the device. A typical p-n junction voltage drop will range from six-tenths to one Volt, which adversely affects the relative performance between an analog locomotive and a DCC locomotive. Multiple p-n junction drops are completely unacceptable, and can all too frequently lead to damage caused by the mismatch between locomotives. Were the switch SW1 to be electronic in nature, it would be very important and most preferred to use a switch which does not incur this semiconductor junction voltage drop, and which is activated at voltages as close to zero as possible. Preferred switches are mechanical or electro-mechanical in nature, and include such devices as jumpers, DIP and standard switches, electro-mechanical relays, and the like which incur only Ohmic losses. Most preferably, the Ohmic losses are kept to an absolute minimum as well.

Motor M1 will most preferably be able to accommodate an analog power supply taken directly from the track, and will also most preferably be able to operate satisfactorily from a wide variety of analog sources. In some cases, this may be accomplished by the inclusion of signal conditioners or other electrical or electronic components in line with motor M1, but, once again, these components should not drop any significant voltage or power, lest the benefits of the present invention be negated. In most cases however, simple selection of an appropriate motor type and winding will suffice to render motor M1 operational on a variety of analog tracks.

While light L1 is illustrated as an incandescent lamp, it will be understood that a great many auxiliary devices are known to be provided and electrically controlled upon a model train. The schematic illustration of an incandescent lamp is purely for purposes of illustration, it being understood that many other auxiliary devices may be similarly controlled or powered as light L1 is disclosed. Whistles, bells, and even electronic sound synthesizers are known to have been incorporated as auxiliary devices, and these and other such devices are contemplated herein.

Figure 4:
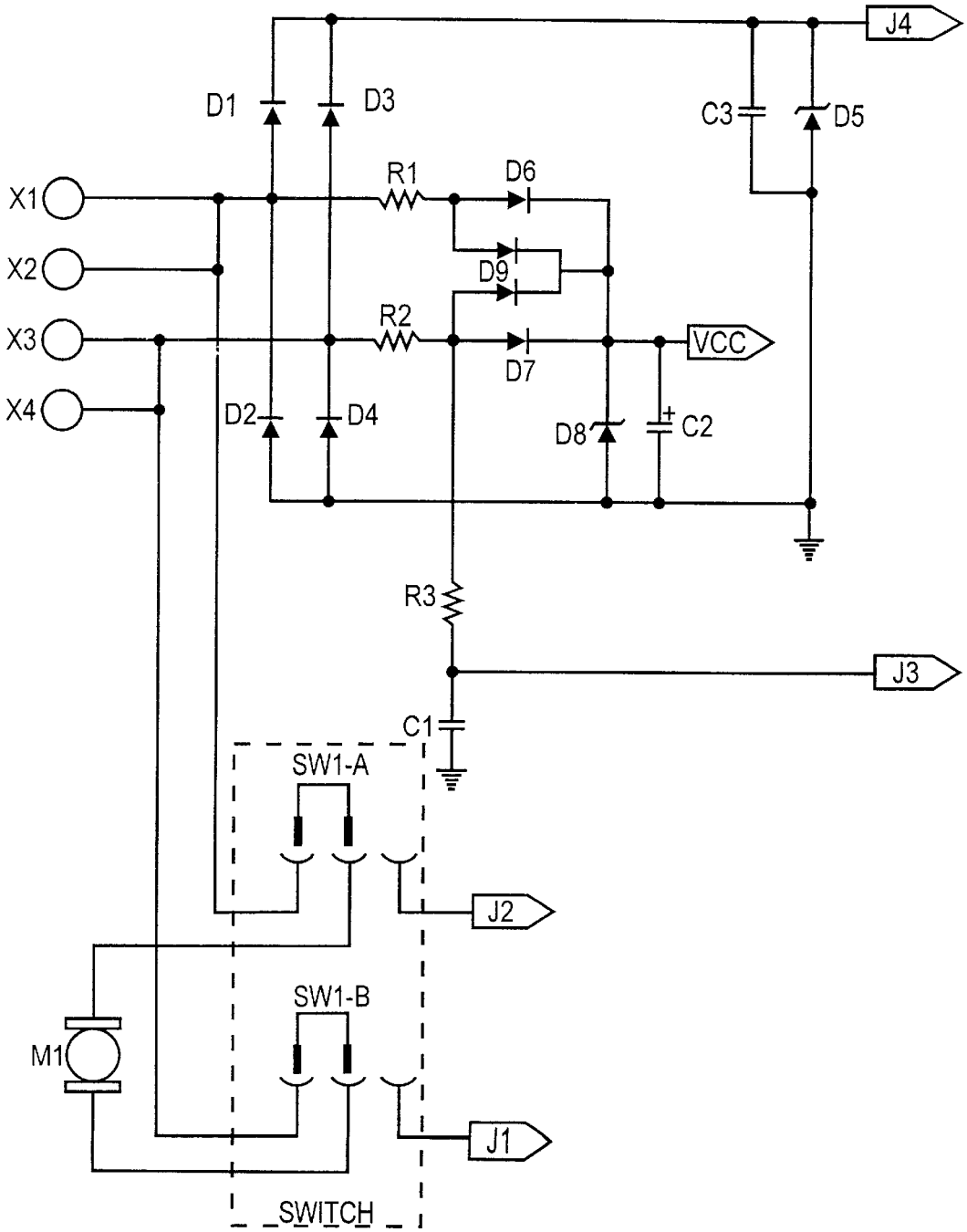
FIG. 4 illustrates by schematic diagram a preferred electrical circuit for implementing the teachings of the present invention in a switch and in a power supply for powering the preferred embodiment decoder.

The dual control locomotive illustrated by block diagram in FIG. 3 may be used on an analog track and may be physically attached to or lashed up with an analog locomotive to form a multiple locomotive train. When so connected, the dual control locomotive should have switch SW1 arranged as shown in FIG. 4, described herein below, to prevent damage to either locomotive or any other components of the model railroad. It is further conceived to include both analog and DCC locomotives operating on the same track and under independent control, or to have multiple locomotive trains operating in the analog mode and separate trains powered by DCC locomotives. The present invention enables a wide variety of combinations of locomotives upon diverse track, thereby extending the compatibility of DCC trains to pre-existing analog tracks.

Figure 5:
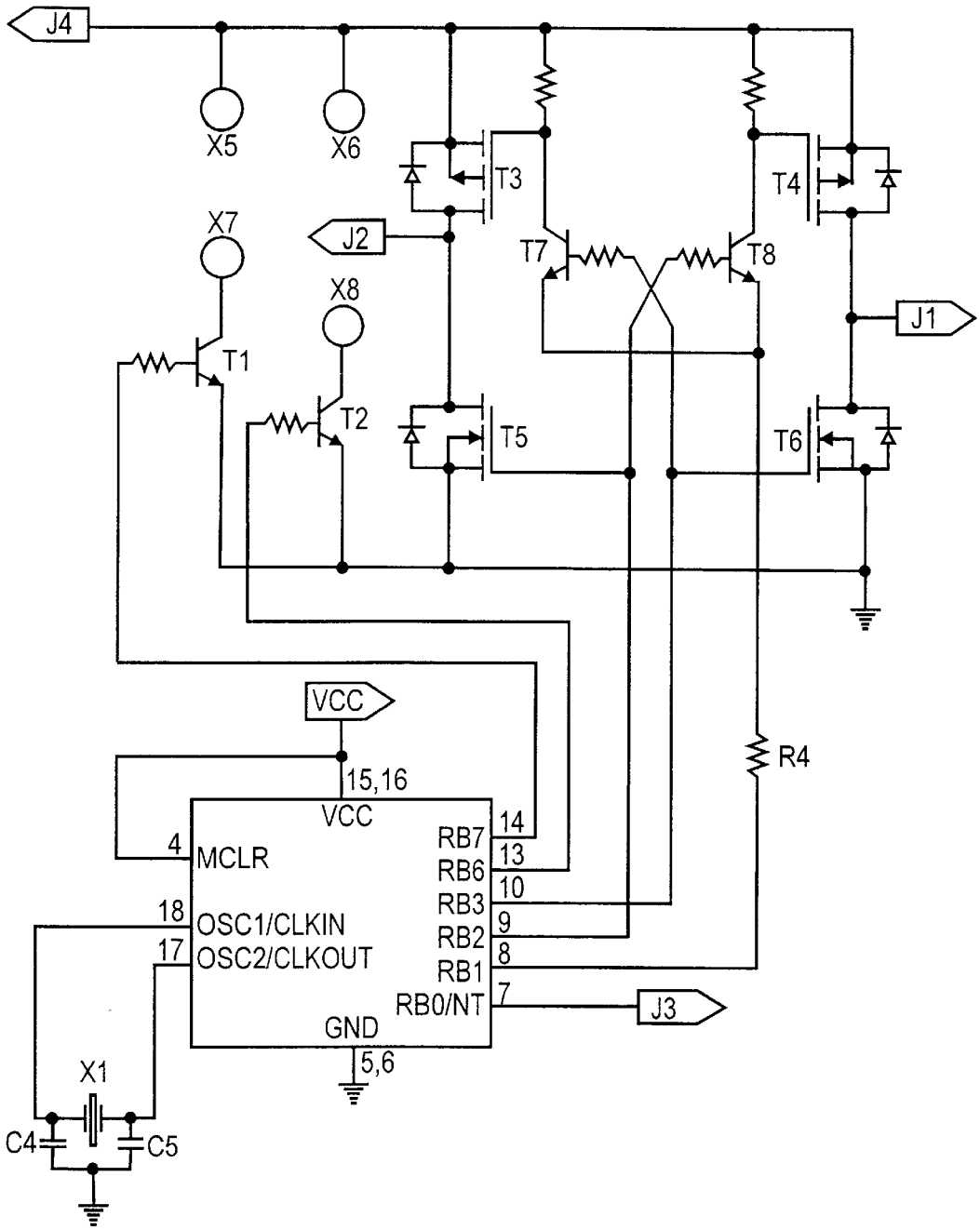
FIG. 5 illustrates by schematic diagram the preferred embodiment decoder.

FIGS. 4 and 5 illustrate schematically the most preferred embodiment of the present invention. FIG. 4 includes switch SWl, which is illustrated therein as a pair of simple jumpers that connect motor M1 directly to the left track pickups X1, X2 through switch SW1-A and to right track pickups X3, X4 through switch SW1-B, as shown in the figure, or alternatively through switch parts SW1-A and SW1-B to the decoder circuitry of FIG. 5, and subsequently to track pickups X1–X4. As aforementioned, switch SW1 may consist of a wide variety of devices that accomplish the basic purpose of a reconfigurable electrical interconnection, including such devices as jumpers, switches, relays and the like. These direct contact Ohmic devices are most preferred for their low loss and high current-capacity characteristics, though those skilled in the art of electrical switching will recognize that there are many other known equivalents that can be implemented into the present invention without departing from the intentions and scope herein. Power for powering the decoder of the present invention is derived through a relatively simple power supply also shown in FIG. 4, which derives energy also from track pickups X1–X4. The power supply includes a first relatively unfiltered supply having a positive voltage at line J4 and a ground, while a second more highly regulated and filtered supply will most preferably be provided between VCC and ground. In the most preferred embodiment, there is very little filtering provided by capacitor C3 and Zener diode D5, other than transient surge suppression. A full-wave bridge rectifier is formed by diodes D1–D4, and this full-wave rectified power source with minimal filtering is then connected through jumper J4 to the decoder circuit as the first power supply. The combination of R1, R2 and relatively large electrolytic capacitor C2 form a much better RC filter for the second more highly regulated power supply, the peak voltage which is limited by Zener diode D8. In the most preferred embodiment, Zener diode D8 may have a Zener voltage of approximately 5.5 volts, which is adequate to power the decoder circuitry, as will be described herein below. Diodes D6 and D7 are most preferably 4148 type diodes, while diode D9 is a dual switching diode such as the BAV70 sold by Motorola, Incorporated. Diodes D6, D7 and D9 cooperate with Diodes D2 and D4 to also form a full wave rectifier. Resistors R1 and R7 in the most preferred embodiment are 1K resistors, while capacitor C2 is most preferably a 47 micro-Farad capacitor, though the exact values of these components is not critical to the operation of the invention, and the values are discussed herein merely to provide a more clear understanding of the relative values and the characteristics that will consequently be associated with this combination of parts.

Resistor R3 and capacitor C1 form another RC filter of intermediate time constant, which acts as a noise and transient suppressor. This provides a pathway for digital signal input to the decoder. In the most preferred embodiment, resistor R3 is a 10K resistor, while capacitor C1 is a 1 nano-Farad capacitor.

FIG. 5 illustrates an elegantly simple decoder, using only twelve discrete components. IC1 is, in the most preferred embodiment, a microcontroller sold by Microchip Technologies Incorporated under the part number PIC16CE625, which incorporates a RISC CPU, RAM data memory, EEPROM data memory, EPROM program memory, clock oscillator, voltage reference and many other functions into a single integrated circuit. Other components or combinations of components may be substituted as is known in the art. Crystal X1 is provided together with capacitors C4 and C5 to form a timing control circuit for IC1. At jumper J3, the signal input from the tracks is provided to IC1, for processing therein. Since IC1 includes program and data memory, a wide variety of functions may be programmed. Among these are the decoding of a data stream, including detection of a designation code that selects this particular decoder as the one being addressed by a command set. Additional functions that may be implemented in software include selection and activation of auxiliary functions, and also the ability to encode functions to vary the actual locomotive acceleration and deceleration to more closely resemble a full-sized locomotive. Data input may include not only the designation code and basic commands such as desired changes in velocity, but also may include initializing information that affects performance characteristics of the train. Initializing information may include, for exemplary purposes only, a load weight that the train will emulate. The load weight will then be used in calculations to alter the model train's acceleration and deceleration. As can be understood, software implementation of the preferred embodiment DCC decoder is very flexible and expandable to offer not only a wide variety of basic function controls, but also allows the inventive decoder to emulate a full-sized train much more accurately.

Output from RB7 of IC1 is delivered to transistor T1, which includes an integral base resistor, to control an auxiliary function such as a light or whistle. Similarly, output from RB6 is provided to transistor T2, which also includes an integral base resistor, to control a second auxiliary function. Power MOSFET transistors T4–T6 form, in combination with transistors T7 and T8, a well-known H-bridge configuration which can provide a signal of most any waveform through jumpers J1 and J2 and switch SW1 to motor M1, in accord with the characteristics of motor M1. This may, for example, be a simple frequency controlled, square wave AC signal, but may alternatively be any other suitable drive signal, such as a pulse width or pulse position modulated signal, as will be selected by the system designer. Each of the power MOSFET transistors T3–T6 will most preferably include integral flyback diodes, and will also have very low source-to-drain "on" resistance, to minimize unwanted power consumption and voltage drop.

Having thus disclosed the preferred embodiment and some alternatives to the preferred embodiment, additional possibilities and applications will become apparent to those skilled in the art without undue effort or experimentation. Therefore, while the foregoing details what is felt to be the preferred embodiment of the invention, no material limitations to the scope of the claimed invention are intended. Further, features and design alternatives that would be obvious to one of ordinary skill in the art are considered to be incorporated herein. For example, while the most preferred embodiment uses rail pickup to provide both power and control signals, other methods for powering and transmitting control signals are contemplated herein as are known in the art. RF transmissions, optical and infra-red signaling, and other similar techniques have been contemplated by the present inventors, though the most preferred embodiment preserves compatibility with existing model tracks. Consequently, rather than being limited strictly to the features recited with regard to the preferred embodiment, the scope of the invention is set forth and particularly described in the claims hereinbelow.

What is claimed is:

1. An electrically powered dual control locomotive which offers compatibility with both digital and analog model railroad control systems, and which may therefore be operated under either analog or DCC control, and which may further be directly connected to an analog locomotive for operation in tandem upon an analog track without damaging either said analog locomotive or said dual control locomotive, comprising:

a coupler which receives electrical power and control signals from a power and control source;

decoder which receives said control signals and said electrical power from said coupler and converts said electrical power, responsive to said control signals, into a variable electric motor drive source;

an electric motor adapted to convert both of said electrical power and said variable electric motor drive source into mechanical energy; and a switch for selectively electrically connecting said electric motor to said electrical power from said coupler in a first configuration and for selectively connecting said electric motor to said variable electric motor drive source in a second configuration.

2. The electrically powered dual control locomotive of claim 1 wherein said switch further comprises a mechanically repositioned connector of conductive material and said switch has a linear, Ohmic voltage drop.

3. The electrically powered dual control locomotive of claim 2 wherein said mechanically repositioned connector further comprises a jumper.

4. The electrically powered dual control locomotive of claim 2 wherein said mechanically repositioned connector further comprises an electrical contactor.

5. The electrically powered dual control locomotive of claim 4 wherein said switch further comprises a DIP switch.

6. The electrically powered dual control locomotive of claim 1 wherein said switch further comprises an electronic switch.

7. The electrically powered dual control locomotive of claim 1 wherein said power and control source further comprises said analog track.

8. The electrically powered dual control locomotive of claim 1 wherein said decoder further converts said electrical power, responsive to said control signals, into an auxiliary power source for components auxiliary to said dual control locomotive.

9. The electrically powered dual control locomotive of claim 8 wherein said auxiliary components further comprise a light.

10. In combination, a Digital Command Control (DCC) decoder having electronic circuitry for receiving and evaluating various digital commands and responsive thereto modifying an input power source to produce a modified power source, an electric motor for converting a motor electrical input supply into mechanical energy, and a power switch for selectively coupling either said decoder or said input power source through an electrical contactor to said motor electrical input supply, said electrical contactor having fixed electrical resistance and a voltage drop therethrough which is linearly related to a current passing therethrough.

11. The combination decoder, motor and switch of claim 10 further comprising a micro-controller having an MCU input for receiving said various digital commands, program instructions to evaluate said various digital commands, and an MCU output for outputting an MCU output signal responsive to said program instructions.

12. The combination decoder, motor and switch of claim 11 wherein said program instructions produce an MCU output which, when selectively coupled through said power switch to said motor electrical input supply, will emulate an acceleration of a loaded full-sized train.

13. The combination decoder, motor and switch of claim 11 further comprising an H-bridge for modifying said input power source responsive to said MCU output.

14. The combination decoder, motor and switch of claim 10 wherein said power switch further comprises an electromechanical switch.

15. The combination decoder, motor and switch of claim 14 wherein said power switch further comprises an electrical jumper.

16. An electric model railroad having an electrically energized track and an analog locomotive which traverses said track and receives electrical power therefrom, said power effecting speed and direction control of said analog locomotive, wherein the improvement comprises a dual-powered locomotive physically attached to said analog locomotive and forming a train therewith, said dual-powered locomotive having an analog power input from said track, a decoder for receiving and converting digital command control signals into a variable motor drive signal, a motor for driving said locomotive having an electrical energy input, and a switch selectively applying said analog power input in a first switching state to said electrical energy input and selectively applying said variable motor drive signal to said electrical energy input in a second state.

17. The electric model railroad of claim 16 wherein said decoder further comprises a micro-controller having both circuitry and programming instructions.

18. The electric model railroad of claim 17 wherein said programming instructions emulate acceleration characteristics of a full scale locomotive within said dual-powered locomotive.

19. The electric model railroad of claim 16 wherein said switch further comprises a mechanical contactor.

20. The electric model railroad of claim 19 wherein said mechanical contactor further comprises a jumper.

* * * * *